United States Patent [19]

Viles

[11] Patent Number: 4,776,726

[45] Date of Patent: Oct. 11, 1988

[54] DOCK CONSTRUCTION

[76] Inventor: Versel Viles, P.O. Box 459, Walloon Lake, Mich. 49796

[21] Appl. No.: 142,514

[22] Filed: Jan. 11, 1988

[51] Int. Cl.[4] ..... E02B 3/20

[52] U.S. Cl. ..... 405/221; 405/218; E02B/3/20

[58] Field of Search ..... 405/3, 7, 202, 218, 405/219, 220, 221; 114/258, 263

[56] References Cited

U.S. PATENT DOCUMENTS

| | | | |
|---|---|---|---|
| 1,912,049 | 5/1933 | Voorhees | 405/221 |
| 2,505,832 | 5/1950 | Lange | 405/3 |
| 2,564,123 | 8/1951 | Melges et al. | 405/221 |
| 2,585,664 | 2/1952 | Le May et al. | 254/91 |
| 2,652,694 | 9/1953 | Melges | 405/221 |
| 3,021,965 | 2/1962 | Harvey | 414/678 |
| 3,074,241 | 1/1963 | Cahill et al. | 405/221 X |
| 3,077,742 | 2/1963 | Brown | 405/3 |
| 3,208,227 | 9/1965 | Armbrust | 405/221 |
| 3,221,899 | 12/1965 | Gronlund | 414/678 |
| 3,293,866 | 12/1966 | Foster | 405/3 |
| 3,572,045 | 3/1971 | Owen | 405/221 X |
| 3,753,355 | 8/1973 | Knoch | 405/3 |
| 3,952,528 | 4/1976 | Donkersloot | 405/221 |
| 4,022,027 | 5/1977 | Tetzner | 405/3 |
| 4,027,492 | 6/1977 | Carpenter | 405/3 |
| 4,349,297 | 9/1982 | Misener | 405/221 |
| 4,352,597 | 10/1982 | Kay | 405/219 |
| 4,381,723- | 5/1983 | Furst | 114/45 |
| 4,398,849 | 8/1983 | Moran et al. | 405/221 |
| 4,507,016 | 3/1985 | Honour, VII | 405/2 |

*Primary Examiner*—David H. Corbin

*Attorney, Agent, or Firm*—Harness, Dickey & Pierce

[57] ABSTRACT

A boat dock construction in which most of the support assembly is left throughout the year in the lake. The support assembly includes a plurality of pairs of pivotable legs which can be pivoted into a vertical position where they can accept H-shaped stanchions. A platform or platform is placed over cross members on the stanchions to complete the assembly. In the late fall, the platform and stanchions are removed for storage while the remainder of the support assembly remains below the water line in the lake.

15 Claims, 2 Drawing Sheets

DOCK CONSTRUCTION

BACKGROUND OF THE INVENTION

1. Technical Field

This invention relates to boat docks and, more particularly, to docks of the type that are generally removed from the water for winter storage.

2. Discussion

The patent literature discloses various designs for boat dock constructions, boat lifts and the like. The following U.S. patents form a representative, although not exhaustive, collection of prior art in this area: U.S. Pat. Nos. 1,912,049; 2,505,832; 2,564,123; 2,585,664; 2,652,694; 3,021,965; 3,077,742; 3,208,227; 3,221,899; 3,293,866; 3,572,045; 3,753,355; 3,952,528; 4,027,492; 4,352,597; 4,381,723 and 4,507,016. Each of these patents purport to have various advantages. However, none are believed to disclose or suggest the present invention.

The present invention is drawn to solving some of the problems associated with seasonal docks which are commonly used by summer cottage owners on lakes. One of the most dreaded tasks is the chore of putting in the boat dock in the spring and taking it out again in late fall. The dock is traditionally removed from the lake to protect it from ice and other weather damage during the winter.

It would, therefore, be advantageous to provide a dock structure that could be easily installed and removed with a minimum of effort while protecting it from winter weather damage.

SUMMARY OF THE INVENTION

In accordance with the teachings of the present invention, the majority of the support structure for the dock remains beneath the water line throughout the year. As a result, the tedious task of reanchoring supporting stanchions and the like is avoided once the dock has been initially installed. The support assembly includes a plurality of pairs of pivotable legs. They are pivoted downwardly out of the way during winter storage but are brought into an upright, vertical position in the spring when the dock is to be put in the lake. A plurality of stanchions are removably and adjustably connected to the legs. Conventional platforms or decks are laid across the cross members of adjacent stanchions to complete the assembly. At the end of the year, the platform is lifted from the stanchions and the stanchions removed from the legs which are then pivoted downwardly out of the way below the water line during the winter.

BRIEF DESCRIPTION OF THE DRAWINGS

The various advantages of the present invention will become apparent to one skilled in the art upon reading the following specification and by reference to the drawings in which.

DESCRIPTION OF THE PREFERRED EMBODIMENT

Figure 1:
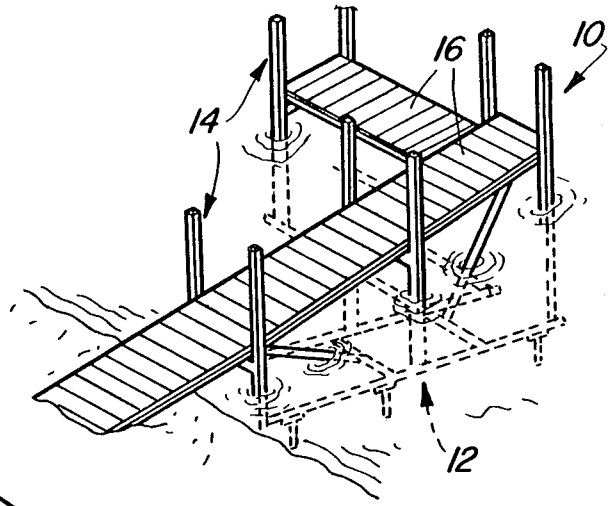
FIG. 1 is a perspective view of a dock made in accordance with the teachings of the preferred embodiment of this invention, the dock being shown installed in a lake.

With reference to the drawings, dock 10 consists primarily of three main components: a support assembly 12, a plurality of removable stanchions 14 and a plurality of deck or platform sections 16. The support assembly 12 is designed to remain in the lake 18 or other body of water once it is initially anchored to the lake floor 20. On the other hand, the stanchions 14 and platform 16 can be easily removed and stored during the winter months.

Figure 5:
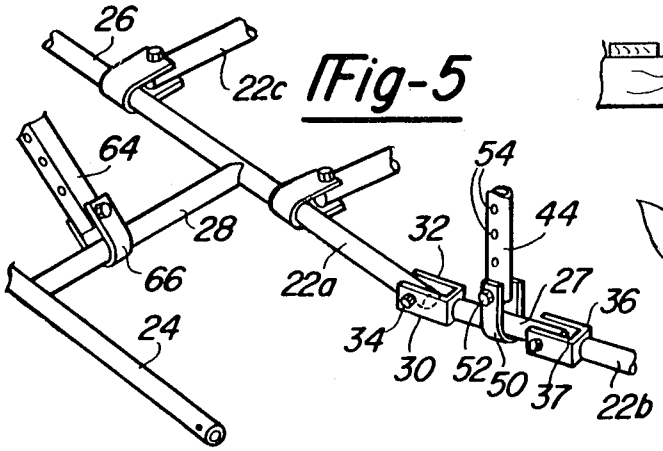
FIG. 5 is a partial perspective view of portions of the support assembly specifically illustrating the connections between three rail sections.

The support assembly 12 shown in the drawings includes three substantially identical rail sections 22(*a, b, c*) which are connected together to form an L-shaped dock. However, it should be understood that any configuration for the dock can be easily made because the rail sections connect together very easily. Each rail section 22 includes a pair of elongated rail members 24 and 26 which are connected together by one or more cross beams 28. In this particular example, the rail members 24 and 26 are about 16 feet long while cross beams 28 are about 2–3 feet in length. Various lengths can be chosen but it is preferable that the rails are not too long so that they can more easily accommodate the different slope angles of the lake floor. Adjacent rails sections can be pivotally connected together in a variety of manners. For example as best shown in FIG. 5, two adjacent rail sections 22*a* and 22*b* can be connected together by shorter shafts 27 having a female bracket 30 on one end which is pivotally connected to the male end of member 26 of section 22*a* via bolt 34. Similarly, the female bracket 36 on the end of section 22*b* is pivotally connected via bolt 37 to the male end of shaft 27. The shafts 27 can be advantageously used when the lake floor 20 is uneven, but need not always be used in which case the male/female ends of the rail sections mate directly.

Figure 2:
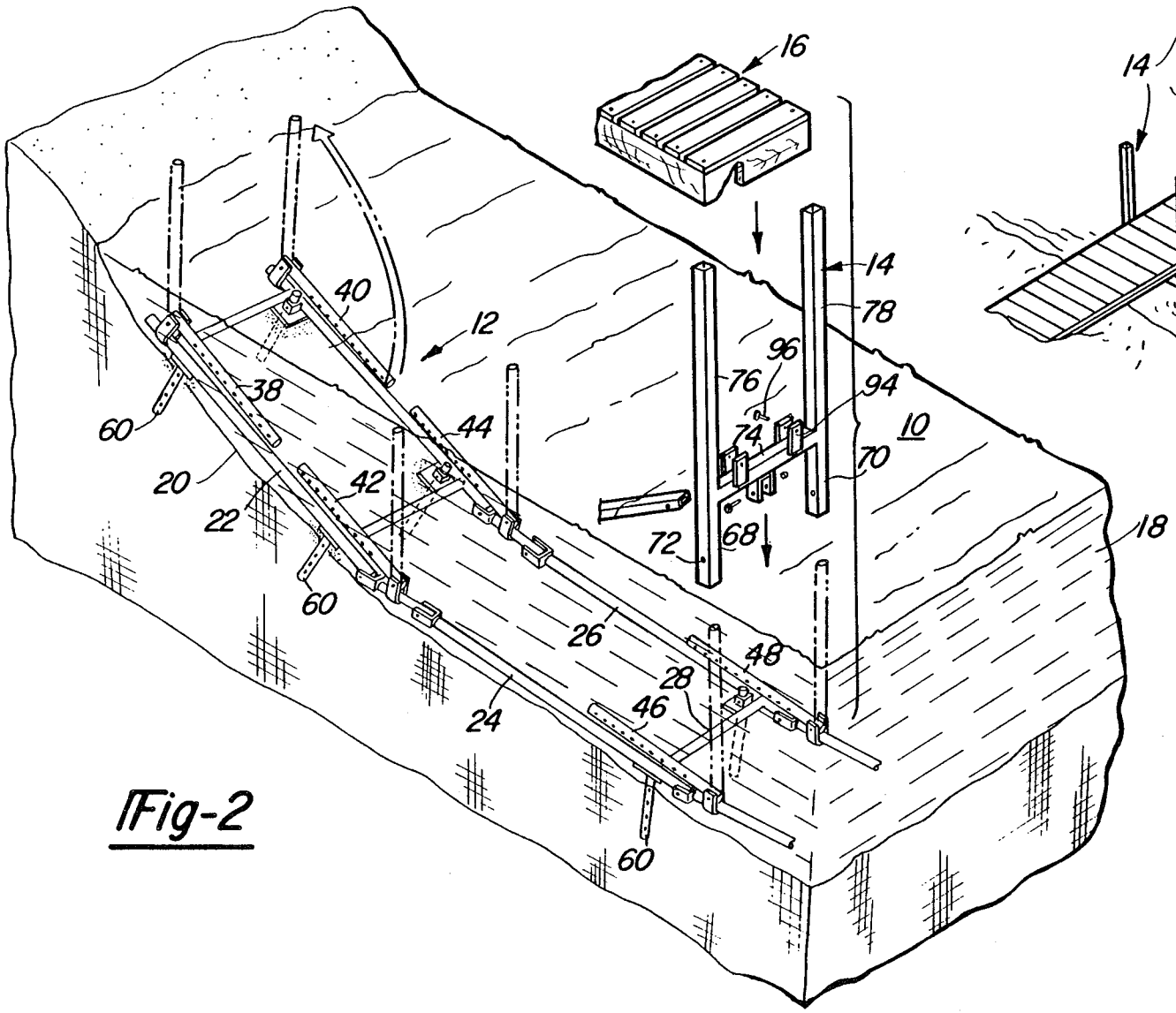
FIG. 2 is an exploded perspective view of various components of the dock, with the support assembly being shown in solid lines as it would appear during winter.

A plurality of pairs of legs are pivotally attached at longitudinally spaced locations on the rail members. In FIG. 2, there are shown three such leg pairs 38, 40; 42, 44 and 46, 48. The leg pairs are so connected to the rail members so that they can lie flush therewith during the winter months as shown in solid lines in FIG. 2. On the other hand, when the dock is in use, they can be pivoted to the vertical position as shown in phantom lines in FIG. 2 and perhaps better shown in FIG. 3. The pivotal connection is made in this embodiment by way of a U-shaped bracket 50 which surrounds the particular rail member and is pinned via bolt 52 through a hole pair in the lowermost portion of the leg. While other pivotal connections can be used, the U-shaped bracket 50 is particularly advantageous because it enables the leg to be slid along the rail member to the appropriate location. Each leg has a plurality of hole pairs 54 for the purposes which will be described. In this embodiment, there are 12 hole pairs located one inch apart along the longitudinal length of the legs.

Figure 4:
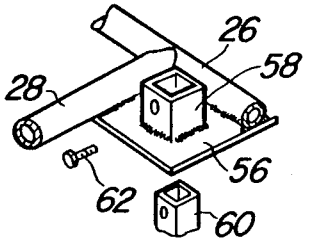
FIG. 4 is a partial perspective view of portions of the support assembly through which stakes for anchoring the support assembly extend.

Provision is made for anchoring the support assembly 12 to the floor 20 of the lake 18. In the preferred embodiment, pads 56 are welded to the intersections of selected rail members and cross beams 28 as shown most clearly in FIG. 4. Each pad 56 has a square opening formed in a raised neck 58. Suitable lengths of posts or stakes 60 are slid through the opening in neck 58 and held in position by way of a fastener 62.

The initial assembly of the support assembly 12 can be performed on shore and then it can be carried out into the lake. Once maneuvered into the appropriate location, the stakes 60 are pounded into the floor 20 to secure the support assembly 12 in place. As will appear, the support assembly 12 preferably further includes one or more brace rods 64 pivotally connected to cross beams 28 by way of U-shaped brackets 66 which are similar to brackets 50 used to connect the legs to the rail members.

Once the support assembly 12 is installed, the legs are pivoted to an upright position for receiving stanchions 14. Each stanchion 14 is substantially identical and includes a pair of hollow lower posts 68, 70 with at least one hole pair 72 located near their lower ends. Each stanchion further includes a cross member 74 and a pair of upper extension arms 76 and 78. The lower portion of cross member 74 includes a U-shaped bracket 80 for receiving the free end of the bracing rod 64.

Figure 3:
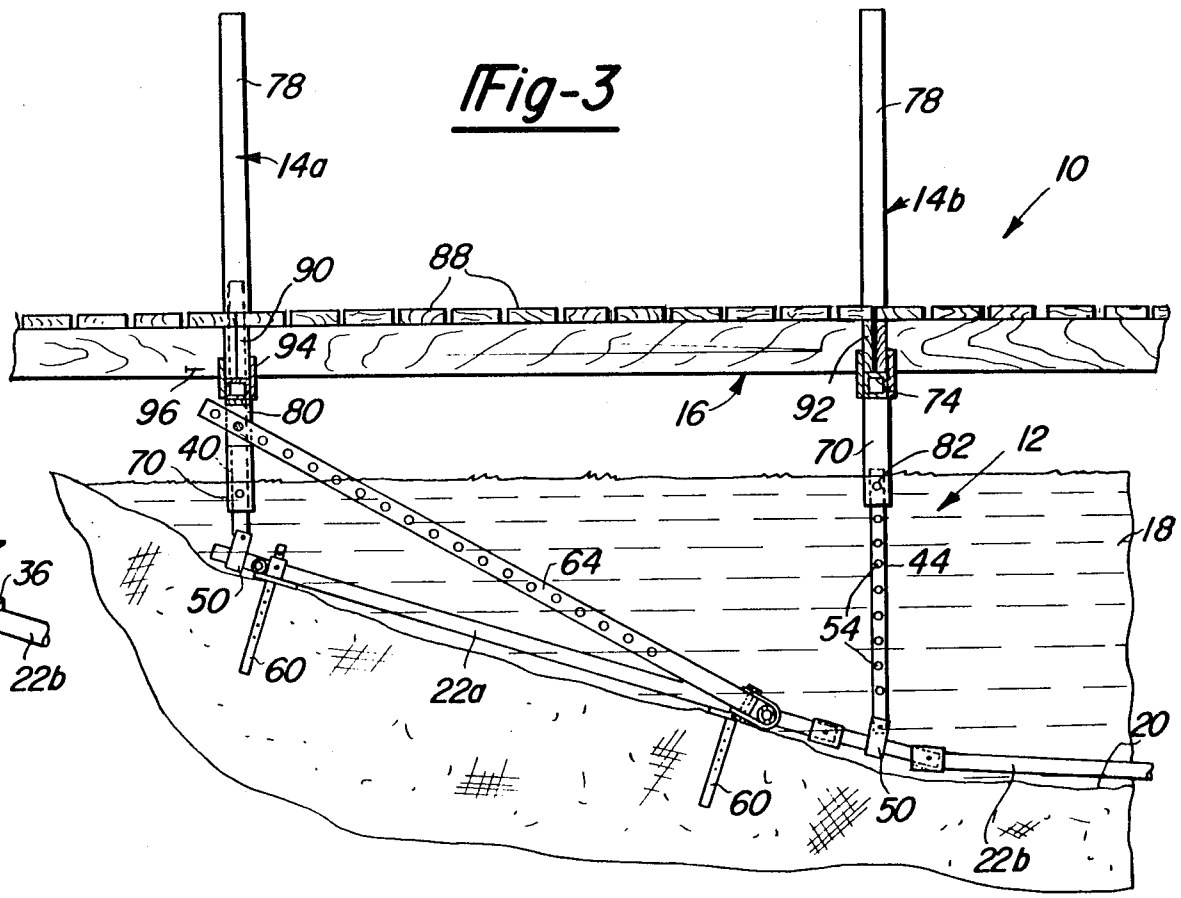
FIG. 3 is a side view of portions of the dock as installed in a lake.
Figure 6:
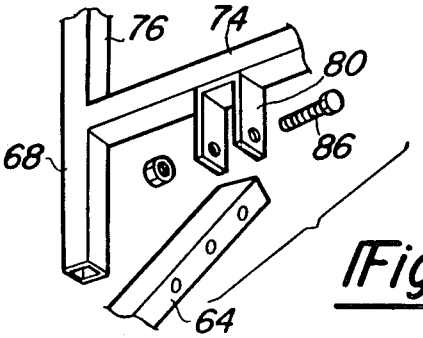
FIG. 6 is an exploded perspective view illustrating the connection of a bracing rod to one of the stanchions.

The hollow posts 68, 70 of the stanchions 14 are slid over the legs of the support structure. As best shown in FIG. 3, pins 82 or other suitable fasteners pass through the holes 72 in the stanchion posts and a selected hole pair 54 in the legs. The hole pair is chosen so that the cross members 74 of adjacent stanchions are substantially horizontal. In FIG. 3 it can be seen that stanchion 14a is slid downwardly over leg 40 a substantially greater distance than the stanchion **14*b* on leg 44. This feature enables the dock to accommodate for different water depths. After the stanchions 14 are appropriately positioned, they are braced in their upright position by connecting one end of bracing rod 64 to the stanchion 14 by way of a fastener 86 passing through selected hole pairs in the bracket 80 and bracing rod 64, respectively, as shown most clearly in FIG. 6. The number of bracing rods 64** will depend upon a variety of factors and need not be used to brace every leg because the deck or platform will also provide a certain amount of rigidity.

The platform 16 conventionally consists of a wood deck having box shaped sides covered with a multiplicity of planks 88. The ends 90 and 92 rest on cross members 74 of adjacent stanchions. Provision may be made for centering the ends on the stanchion cross members. To this end, upright tabs 94 can be provided to help hold the platform 16 onto the stanchions. Fasteners 96 passing through the tabs and into the sides of the platform can also be used, if desired.

One of the major features of this invention is that portions of the dock can be easily removed for winter storage. All that need be done is to remove the platform 16 and stanchions 14 from the underlying support assembly 12. The support assembly 12 remains beneath the water level during winter and because of its construction, is not susceptible to major damage from ice and other adverse conditions. In the spring, it becomes an easy task to reassemble the dock by pivoting the legs upwardly, sliding the stanchions onto the legs and placing the platforms between the stanchions.

It should be understood that while this invention has been described in connection with one example, that various modifications will become apparent after having the benefit of reading the foregoing specification, and studying the drawings and the following claims.

What is claimed is:

1. A dock comprising:

a support assembly adapted to remain beneath the water line throughout the year, said support assembly including at least one rail section including a pair of elongated rail members, a plurality of pairs of legs located at spaced locations along the rail members, means for pivotally connecting the legs to the rail members so that they can be pivoted from a vertical position to a substantially horizontal position beneath the water line during times when the dock is not desired to be used, and means for anchoring the support assembly to the floor of a body of water;

a plurality of stanchions having a pair of lower posts and a cross member; and connecting means for removably connecting each stanchion to a pair of vertically oriented legs whereby a platform can be placed on the cross members of adjacent stanchions when it is desired to use the dock, with the platform and stanchions being removed for storage and the legs pivoted back towards the rail members during winter or other times of nonuse.

2. The dock of claim 1 which further comprises:

adjustment means for adjusting the height of the stanchions so that the cross members of the stanchions can be leveled.

3. The dock of claim 1 wherein the legs include a series of hole pairs located along the lengths thereof, wherein the posts of each stanchion are hollow and fit over a pair of legs, and wherein the stanchions are secured at adjustable heights by pins passing through selected hole pairs in the legs.

4. The dock of claim 3 which further comprises:

brace means for bracing at least one stanchion in the vertical position.

5. The dock of claim 4 wherein said brace means comprises:

a rod pivotally attached at one end to the cross beam of the rail section and to the stanchion at an opposite end thereof.

6. The dock of claim 5 wherein each stanchion cross member includes at least one vertically extending tab, and wherein fastener means passing through the tabs and into sides of the platform are employed to secure the platform to the stanchions.

7. A dock construction that can be easily installed and removed from a floor of a lake, said dock comprising:

a support assembly adapted to remain beneath the water line throughout the year, said support assembly including a plurality of rail sections, each rail section including a pair of elongated rail members connected together by a transversely extending cross beam, means for pivotally connecting together ends of adjacent rail members together so that adjacent sections can bend to follow the contour of the floor of the lake, a plurality of pairs of legs located at longitudinally spaced locations on the rail members, pivot means for pivotally connecting the legs to the rail members so that the legs can be pivoted from a vertical position to a position lying substantially flush with the rail members during times when the dock is not in use, each leg having a series of hole pairs located along the length thereof, a bracing rod pivotally connected at one end to the cross beam, the bracing rod including a series of spaced hole pairs along the length thereof, anchor means for anchoring the support assembly to the floor of the lake;

a plurality of H-shaped stanchions having a pair of hollow lower posts with a hole pair therein, a cross member with an upwardly extending tab thereon and a pair of upper extension arms, the stanchions each including a bracket extending from lower portions of the cross member;

said legs being pivoted to the vertical position, each stanchion being removably connected to a pair of legs by slipping the hollow lower posts over the legs, fasteners passing through the holes in the stanchion posts and a selected hole pair in the legs, the leg hole pair being selected so that the cross members of the stanchions are substantially horizontal;

a wooden platform extending between adjacent stanchions and lying on the cross members thereof, fastener means passing through the tabs on the cross members into sides of the platform for securing same thereto, with the brace rod being pivoted at an angle relative to the cross rail and being attached to the bracket on the stanchions.

8. The dock of claim 7 wherein the legs are connected to the rail sections by U-shaped brackets surrounding the rail section and slideable thereon, and fastening means passing through the bracket and lower portion of said legs whereby the legs can be positioned at desired locations along the lengths of the rail members.

9. A method of installing, using, and removing a dock from the floor of a lake, said method comprising:

anchoring a support assembly having a plurality of pivotable legs thereon to the floor of the lake;

pivoting the legs to a vertical position;

sliding lower posts of stanchions onto the legs on the support assembly;

vertically adjusting the degree of overlap between the stanchion posts and legs to level cross members of the stanchions;

lying a platform onto the cross members of adjacent stanchions;

walking on the platform during the summer season;

thereafter, lifting the platform from the stanchions, raising the stanchions upwardly from the legs, and pivoting the legs downwardly below the water line; and storing the platform and sstanchions while leaving the support assembly in the water during the winter.

10. The method of claim 9 which further comprises:

slideably connecting the legs to rail members so that the legs can be slid along the lengths thereof to a desired location.

11. The dock of claim 1 wherein said stanchions are generally H-shaped and include a pair of upper extension arms.

12. The dock of claim 1 wherein said elongated rail members are connected together by at least one cross beam.

13. The dock of claim 1 wherein said means for pivotally connecting the legs to the rail members comprise:

U-shaped brackets surrounding the rail section and slideable thereon, and fastening means passing through the brackets and lower portion of said legs whereby the legs can be positioned at desired locations along the lengths of the rail members.

14. The method of claim 9 wherein said stanchions are generally H-shaped, including a pair of upper extension arms.

15. The method of claim 9 wherein said lower posts are hollow and they are slid over the legs of the support assembly.

* * * * *